United States Patent [19]

Wagers

[11] Patent Number: 4,971,241

[45] Date of Patent: Nov. 20, 1990

[54] FAST FLO DRUMS

[75] Inventor: Rex E. Wagers, Kingsport, Tenn.

[73] Assignee: Greif Brothers Corporation, Delaware, Ohio

[21] Appl. No.: 460,565

[22] Filed: Jan. 3, 1990

[51] Int. Cl.[5] ..... B65D 3/14

[52] U.S. Cl. ..... 229/5.6; 229/5.5

[58] Field of Search ..... 229/5.5, 5.6, 5.8; 220/67

[56] References Cited

U.S. PATENT DOCUMENTS

| | | | |
|---|---|---|---|
| 2,160,072 | 5/1939 | Karl | 229/5.5 |
| 2,173,585 | 9/1939 | Harrison | 229/5.5 |
| 2,347,417 | 4/1944 | Kraft | 229/5.5 |
| 2,370,018 | 2/1945 | Cosmo | 229/5.5 |
| 2,409,460 | 10/1946 | Waters | 229/5.5 |
| 3,105,787 | 10/1963 | Carpenter, Sr. et al. | 229/5.6 |
| 3,151,012 | 9/1964 | Bergstrom | 229/5.5 |
| 4,303,190 | 12/1981 | Ditto et al. | 229/5.6 |
| 4,333,585 | 6/1982 | Del Bon | 229/5.5 |
| 4,785,992 | 11/1988 | Goeppner | 229/5.5 |

*Primary Examiner*—Gary E. Elkins

*Attorney, Agent, or Firm*—Kane, Dalsimer, Sullivan, Kurucz, Levy, Eisele and Richard

[57] ABSTRACT

A drum for transporting viscous fluids and the like is disclosed. The improvement of this drum consists of a bottom assembly which breaks away from the bottom closure element when a force is applied to the bottom by a ram. The break away bottom is forced up through the drum by a ram, thereby forcing the contents out through the top of the drum.

10 Claims, 3 Drawing Sheets

FIG. 1
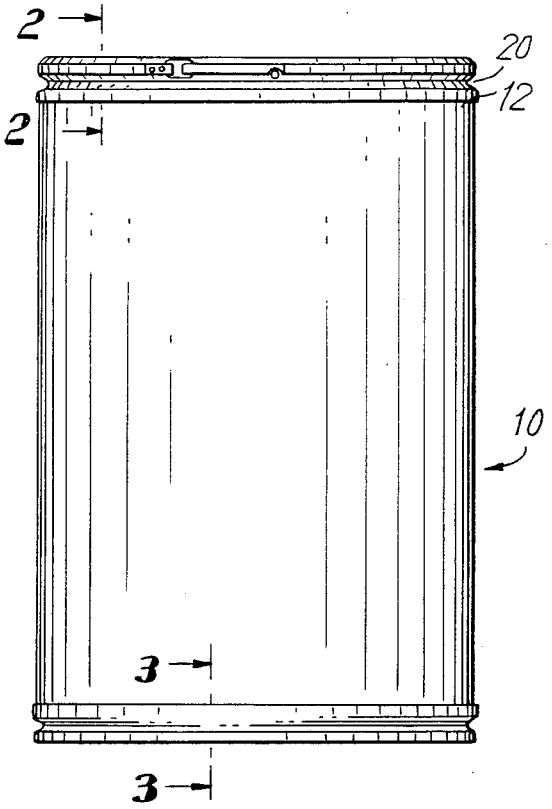
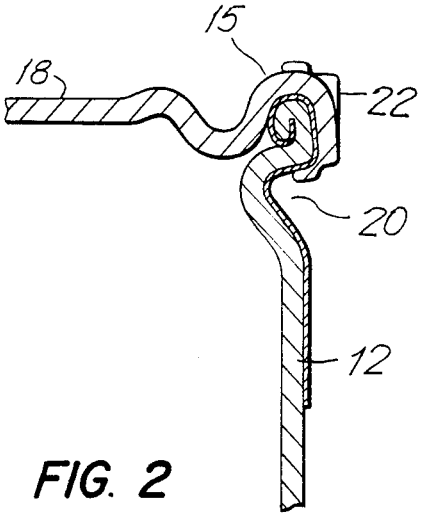
FIG. 2

FIG. 5
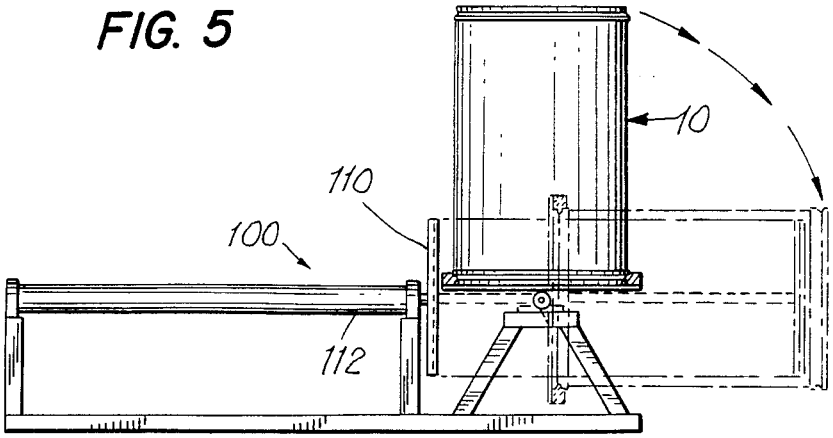
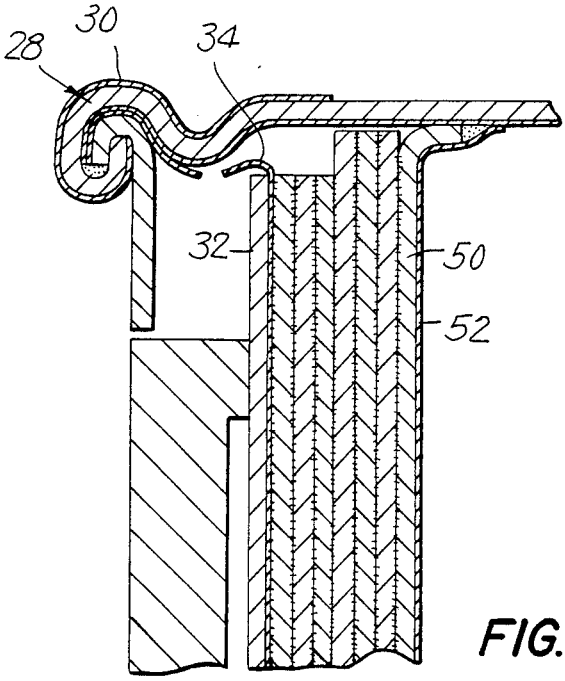
FIG. 6

FAST FLO DRUMS

BACKGROUND OF THE INVENTION

Fibre drums are barrel-like containers which are used to ship and store fluids. The advantages of a fibre drum are that it can hold a large volume of fluid, it is sturdy and resilient so as to be able to withstand the rigors of rough handling during transport, and if the fluid is of low viscosity, the contents can be removed either by pouring or pumping. However, because of the poor flow characteristics of high viscosity fluids a greater effort must be expended in unloading the fluid from the drums. One method which can be used is to heat the fluid containing drum, for as the temperature of fluid rises, its fluid viscosity decreases, thereby improving the fluid's flow properties. However, this method cannot be used where the fluid changes chemical composition upon heating. For these fluids, the only method heretofore available have been raking it or shoveling it out of the drum. However, these methods are time consuming and waste valuable manpower hours. Furthermore, shoveling or raking are wasteful because it is difficult to remove all of the contents from the drum.

Presently available are drums designed to solve a variety of unloading problems. Drums available from Greif Bros. Corp., Cullman, Ala., are of the kind described above, which permit the contents to be heated. The drum is placed into a pressure and heating mechanism having a plunger assembly. After heating to liquefy the contents, the plunger is lowered and pushed against the drum contents, melting the material. The plunger, which seals around the circumference of the drum, pumps out the contents of the drum. Greif Bros. Corp. also manufacturers drums which do not utilize heat in the unloading, but which employ a ram which exerts hydraulic pressure down upon the drum contents, forcing it out of the drum.

SUMMARY OF THE INVENTION

It is an object of the invention to create a fibre drum from which the unloading of viscous materials can be achieved quickly and efficiently.

It is a further object of the invention to provide a fibre drum from which the unloading of viscous fluids will occur without waste.

Other objects of the invention shall become apparent from the description below.

The invention is a fibre drum whose bottom is comprised of a series of discs and release liners glued together and locked into registration with caulking at the point where a metal chime holds the entire bottom closure together. In order to unload the drum, the drum is placed in a machine which turns the drum to the horizontal position. A pneumatic ram then presses against the fibre bottom construction, causing the fibre bottom to break away from the ring portion of the drum bottom, which remains fixed in place. The movement of the fibre bottom causes the rupture of the release liners, and the entire bottom construction is pushed up through the drum towards its top by the ram, so that the fibre bottom acts as a piston and forces the entire contents of the drum out through the top of the drum.

BRIEF DESCRIPTION OF THE DRAWING

FIG. 1 is a side view of the present invention.

FIG. 2 is a cross sectional view of the drum closure.

FIG. 5 depicts the fibre drum as it is placed upon the drum assembly.

FIG. 6 is a cross sectional view depicting the action of the drum bottom moving up through the drum.

DETAILED DESCRIPTION OF THE PREFERRED EMBODIMENT

Figure 4:
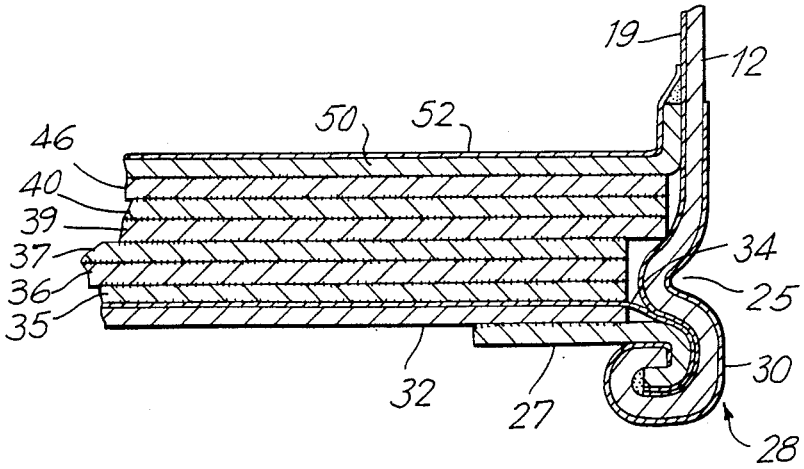
FIG. 4 is a cross sectional view of another embodiment of the drum bottom.

The sidewalls of the drum 10 are constructed of a fibre material. As shown in FIG. 2, at the very top of the drum, a two ply seam 15, is formed in the sidewall 12 by mechanical means, which fits within the rim of a fibre cover 18. Immediately below the two ply seam a bead 20 is formed in the sidewall. The fibre cover and sidewalls are coated with release liners. The fibre cover 18 is fastened onto the top of the drum by a standard lock rim closure 22 which holds the fibre cover 18 and the sidewall 12 together at the point where the cover fits over the two ply seam 15.

Figure 3:
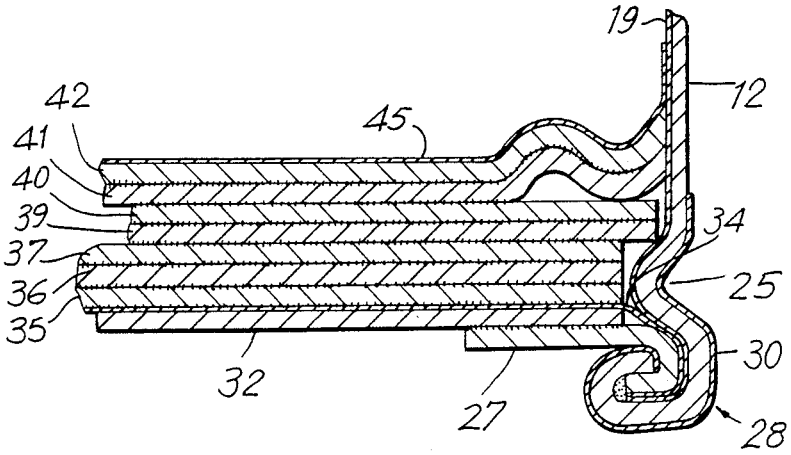
FIG. 3 is a cross sectional view of one embodiment of the drum bottom.

As shown in FIG. 3, at the bottom of the drum, the sidewall posesses a bead 25 similar to that at the top of the sidewall. The drum bottom comprised of individual fibre discs. The bottom most disc 27 is actually ring shaped. This ring shaped disc is joined with the fibre sidewall and through mechanical means, a five ply seam 28 is formed. Caulking is utilized to make the seam leak proof. A metal chime 30 strengthens the seam and prevents it from unraveling so as to insure that the five ply seam 28 remains fastened in place.

It should be noted that if stronger seams are necessary, a method such as that disclosed in U.S. Pat. No. 4,263,860 may be utilized to create the stronger seams.

Securely glued to top the ring shaped disc 27 is a fibre cover element 32, which is a solid fibre disc. Upon this fibre cover element a release liner 34 is adhesively fastened. The release liner 34 projects outwardly and is locked into place between the ring shaped disc 27 and fibre sidewall 12 when the five ply seam 28 is formed. Also locked into the five ply seam is the release liner 19 adhered to the fibre sidewall. The purpose of these two release liners 19 and 34, as with all other release liners described herein, is to insure that the drum is leak proof. The release liners described in this invention are composed of non-permeable membranes such as silicone rubber or polyurethyane.

Upon the fibre cover element 32 and the release liner 34 come a series of additional fibre cover elements 35, 36, and 37, which are adhesively fastened or glued together. Upon these fibre cover elements are glued modified bottom elements 39 and 40, and glued upon this element are two inverted fibre covers 41 and 42, which are glued to each other. Such fibre covers were previously disclosed in U.S. Pat. No. 3,105,787. It should be noted that these elements may be singular or a plurality. These inverted fibre covers are characterized by their wave shape at a point close to the fibre sidewalls. This shape is advantageous because it creates the piston like effect upon unloading of the drum. Upon the uppermost of the inverted fibre elements is adhesively fastened a release liner 45 which projects outwardly and joins with the release liner 19 in the fibre sidewalls. It is sufficient to bond these release liners together with caulking.

In an alternative embodiment, depicted in rigure 4, the two inverted fibre covers are replaced by one inverted bottom element 50, such as those previously disclosed in U.S. Pat. No. 3,182,571, which lacks the wave shape and instead is curved and hugs the fibre sidewall. This is an alternative means of generating the piston like effect. This element is coated with a release liner 52 which joins with the release elements of the fibre sidewall in the aforedescribed manner.

It is to be noted that the various elements which comprise the drum bottom need not be of the same diameter. As a practical matter, the diameter will have to vary because the bead 25 at the bottom of the fibre sidewall creates a differentiation of inside diameter of the drum. A practitioner of the invention will find it necessary to employ different sized elements in order to insure that the various elements fit snugly against the fibre sidewalls and that the entire bottom element clears the bead during the unloading operation.

In the unloading process depicted in FIG. 5, the drums are placed in a machine 100 which turns the drum to the horizontal position. A ram 110 on the machine, powered by a pneumatic or hydraulic cylinder comes in contact with the fibre cover element 32, breaking it and consequently all of the elements above it away from the ring shaped disc, 27 which remains firmly in place since it is locked into the five ply seam 28 and the chime 30. The force of the ram 110 pushing the fibre cover element and other elements causes the release liners 34 and 52 attached to the bottom elements to fracture, and the entire bottom construction is pushed up through the drum towards the top. The inverted fibre covers 41 and 42 or the inverted bottom element 50, depending upon the embodiment, have a piston-like effect due to their configurations and force the contents of the drum out through the top. The release coating on the top of the disc which is in contact with the fluid acts as a sealing means which prevents the viscous contents from sticking to the discs as they are pushed through the top of the drum.

I claim:

1. A fibre drum having sidewalls and a drum bottom comprised of a ring shaped disc, said disc and sidewalls being formed into a seam by leak proofing means sealing the seam, and at least one solid circular disc having a top and bottom secured to the ring shaped disk, a release liner fastened to the top of the solid circular disc, a release liner fastened to the fibre sidewalls, said release liners being comprised of non-permeable material and being fastened within the seam in order to make the drum leakproof.

2. A fibre drum set forth in claim 1 wherein a plurality solid circular discs are fastened together and a release liner upon the uppermost of the solid circular disc which projects outwardly and is attached to the release liners of the fibre sidewalls by means of caulking.

3. A fibre drum according to claim 2 whereby the uppermost disk exhibits a curvature in proximity to the fibre sidewall.

4. A fibre drum according to claim 3 where a plurality of the uppermost disks exhibit a curvature in proximity to the fibre sidewall.

5. A fibre drum as set forth in claims 1–4 whereby a bead exists in the fibre sidewall at a point above the seam.

6. A fibre drum according to claim 2 wherein the uppermist disk is an inverted fibre drum bottom.

7. A fibre drum according to claim 6 wherein a plurality of the uppermost disks are comprised of inverted fibre drum bottoms.

8. A fibre drum according to claim 2 wherein the uppermost disk is a fibre cover element.

9. A fibre drum according to claim 8 wherein a plurality of the uppermost disks are comprised of fibre cover elements.

10. A fibre drum having sidewalls and a drum bottom comprised of a ring shaped disc, said disc and sidewalls being formed into a seam by leak proofing means sealing the seam and at least one solid circular disc having a top and bottom secured to the ring shaped disk, a release liner fastened to the top of the solid circular disc, a release liner fastened to the fibre sidewalls, said release liners being comprised of non-permeable material the release liner upon the solid circular disk being attached to the release liner of the fibre sidewall with caulking and the release liner upon the fibre sidewall being fastened within the seam in order to make the drum leakproof.

* * * * *